US010626702B2

(12) United States Patent
Ornelaz et al.

(10) Patent No.: US 10,626,702 B2
(45) Date of Patent: Apr. 21, 2020

(54) FLOW CONTROL DEVICES WITH PRESSURE-BALANCED PISTONS

(71) Applicant: HALLIBURTON ENERGY SERVICES, INC., Houston, TX (US)

(72) Inventors: Richard Decena Ornelaz, Frisco, TX (US); Michael Linley Fripp, Carrollton, TX (US); Thomas Jules Frosell, Irving, TX (US); John C. Gano, Lowery Crossing, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 189 days.

(21) Appl. No.: 15/564,726

(22) PCT Filed: Dec. 27, 2016

(86) PCT No.: PCT/US2016/068707
§ 371 (c)(1),
(2) Date: Oct. 5, 2017

(87) PCT Pub. No.: WO2018/125048
PCT Pub. Date: Jul. 5, 2018

(65) Prior Publication Data

US 2018/0283134 A1 Oct. 4, 2018

(51) Int. Cl.
*E21B 34/06* (2006.01)
*E21B 43/08* (2006.01)
(Continued)

(52) U.S. Cl.
CPC ..... *E21B 34/066* (2013.01); *E21B 41/0085* (2013.01); *E21B 43/08* (2013.01);
(Continued)

(58) Field of Classification Search
CPC ..... E21B 34/066; E21B 43/08; E21B 43/12; E21B 41/0085; E21B 47/12; E21B 43/14; E21B 49/08; E21B 43/084; E21B 34/101
See application file for complete search history.

(56) References Cited

U.S. PATENT DOCUMENTS 7,891,430 B2 2/2011 Willauer
8,607,873 B2 12/2013 Aadnoy
(Continued)

FOREIGN PATENT DOCUMENTS

WO 2008004875 A1 1/2008
WO 2014123539 A1 8/2014
WO 2015031745 A1 3/2015

OTHER PUBLICATIONS

Volkov et al., Adaptive Inflow Control System, Article—Aug. 2014; WORMHOLES Ltd.
International Search Report and Written Opinion for PCT/US2016/068707 dated Sep. 8, 2017.
French Search Report for corresponding Patent Application No. FR1761192; dated May 27, 2019; 9 pages.

*Primary Examiner* — Brad Harcourt
(74) *Attorney, Agent, or Firm* — McGuireWoods LLP

(57) ABSTRACT

A sand control screen assembly includes a base pipe and a flow control device positioned within a flow path for a fluid that extends between the exterior and the interior of the base pipe. The flow control device includes a housing defining an inlet that receives the fluid from the flow path and an outlet that discharges the fluid back into the flow path, and a piston chamber is defined in the housing to fluidly communicate the inlet with the outlet. A pressure-balanced piston is positioned within the piston chamber and movable between a first position, where fluid flow between the inlet and the outlet is prevented, and a second position, where fluid flow between the inlet and the outlet is facilitated. An actuator moves the pressure-balanced piston between the closed and
(Continued)

open positions, and an electronics module is communicably coupled to the flow control device to operate the actuator.

19 Claims, 10 Drawing Sheets

(51) Int. Cl.

| | |
|---|---|
| ***E21B 43/14*** | (2006.01) |
| ***E21B 49/08*** | (2006.01) |
| ***E21B 47/12*** | (2012.01) |
| ***E21B 41/00*** | (2006.01) |
| ***E21B 43/12*** | (2006.01) |

(52) U.S. Cl.
CPC ..... *E21B 43/084* (2013.01); *E21B 43/12* (2013.01); *E21B 43/14* (2013.01); *E21B 47/12* (2013.01); *E21B 49/08* (2013.01)

(56) References Cited

U.S. PATENT DOCUMENTS

| | | | | |
|---|---|---|---|---|
| 8,752,629 | B2 | 6/2014 | Moen | |
| 8,833,466 | B2 | 9/2014 | Zhou | |
| 2011/0030969 | A1 | 2/2011 | Richards | |
| 2011/1098097 | | 8/2011 | Moen | |
| 2014/0338922 | A1* | 11/2014 | Lopez | E21B 43/12 166/373 |
| 2015/0040990 | A1 | 2/2015 | Mathiesen et al. | |
| 2015/0060084 | A1 | 3/2015 | Moen et al. | |
| 2015/0261224 | A1* | 9/2015 | Lopez | G05B 15/02 700/282 |
| 2016/0215595 | A1 | 7/2016 | Lopez et al. | |
| 2016/0341013 | A1* | 11/2016 | Hall | E21B 41/0085 |

* cited by examiner

FLOW CONTROL DEVICES WITH PRESSURE-BALANCED PISTONS

BACKGROUND

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as production tubing. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to downhole fluid flow regulation and, more particularly, to sand control screen assemblies having flow control devices that use a pressure-balanced piston and associated actuator to regulate fluid flow production.

The embodiments described herein discuss flow control devices designed as force-balanced flow controllers that include a balanced piston assembly actuatable to regulate fluid flow along a flow path extending into an interior of a base pipe. The balanced piston assembly operates to balance hydraulic forces within the flow control device, even when the flow control device is only partially closed. Consequently, the balanced piston assembly minimizes the power and size requirements of an actuator needed to actuate the flow control device. Advantageously, the minimal power and size requirements for the actuator allows the balanced piston assembly to be shifted based on a magnetic coupling, which eliminates the need for dynamic seals. The flow control devices described herein may reduce or prevent altogether the production of undesired wellbore fluids, such as water. While existing technologies are either passive or require the fluid to start production before controlling the flow, the sand control screen assemblies described herein include sensors that monitor the fluid and are communicably coupled to the flow control devices. Consequently, as the well nears its useful life, sensor data allows the flow control device to slow production and thereby prevent water breakthrough.

Figure 1:
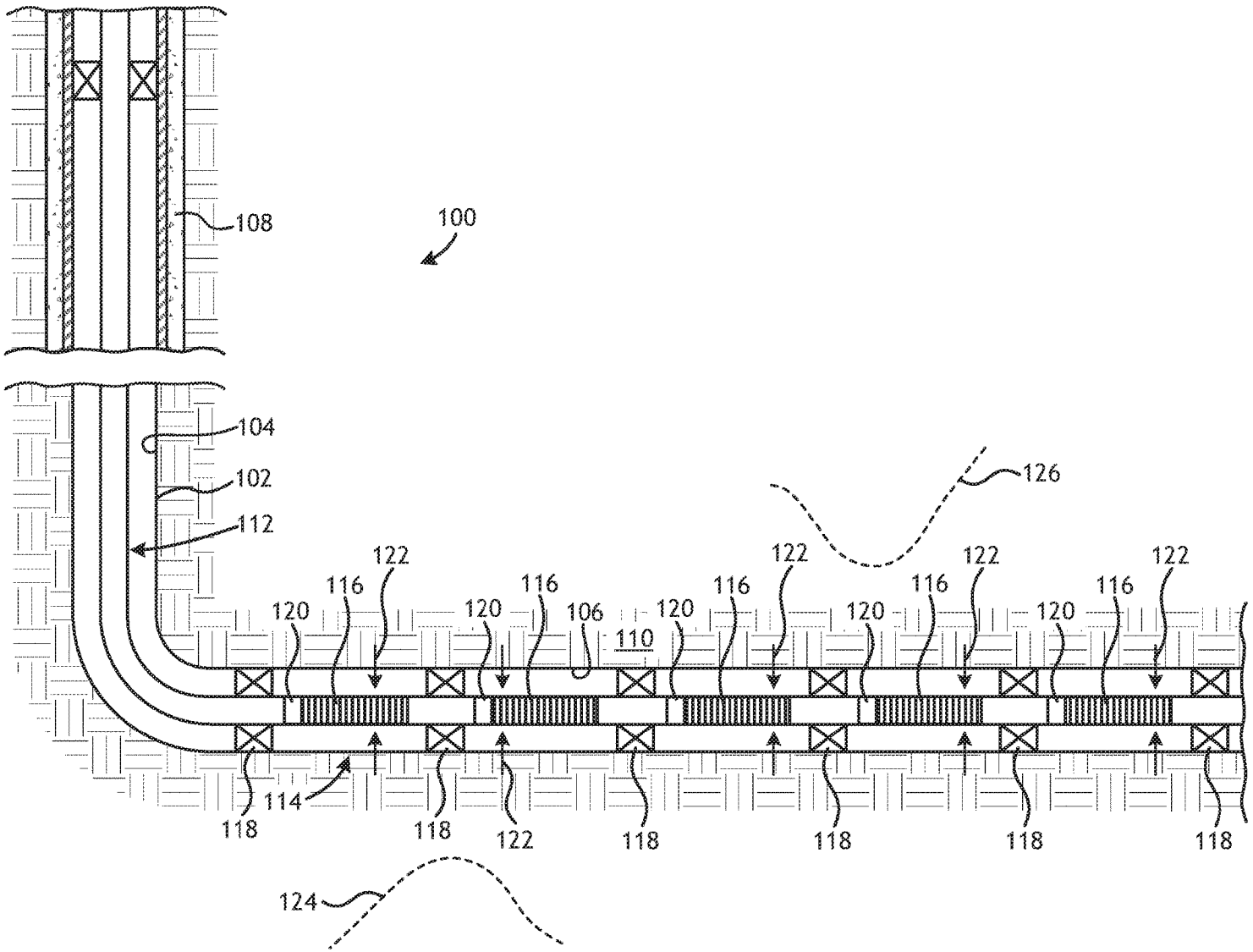
FIG. 1 is a schematic drawing of a well system that may employ the principles of the present disclosure.

FIG. 1 is a schematic diagram of an exemplary well system 100 that may employ one or more of the principles of the present disclosure, according to one or more embodiments. As depicted, the well system 100 includes a wellbore 102 that extends through various earth strata and has a substantially vertical section 104 that transitions into a substantially horizontal section 106. A portion of the vertical section 104 may have a string of casing 108 cemented therein, and the horizontal section 106 may extend through a hydrocarbon bearing subterranean formation 110. In some embodiments, the horizontal section 106 may be uncompleted and otherwise characterized as an "open hole" section of the wellbore 102. In other embodiments, however, the casing 108 may extend into the horizontal section 106, without departing from the scope of the disclosure.

A string of production tubing 112 may be positioned within the wellbore 102 and extend from a surface location (not shown), such as the Earth's surface. The production tubing 112 provides a conduit for fluids extracted from the formation 110 to travel to the surface location for production. A completion string 114 may be coupled to or otherwise form part of the lower end of the production tubing 112 and arranged within the horizontal section 106. The completion string 114 divides the wellbore 102 into various production intervals adjacent the subterranean formation 110. To accomplish this, as depicted, the completion string 114 may include a plurality of sand control screen assemblies 116 axially offset from each other along portions of the production tubing 112. Each screen assembly 116 may be positioned between a pair of wellbore packers 118 that provides a fluid seal between the completion string 114 and the inner wall of the wellbore 102, and thereby defining discrete production intervals.

One or more of the sand control screen assemblies 116 may further include a flow control device 120 used to restrict or otherwise regulate the flow of fluids 122 into the completion string 114 and, therefore, into the production tubing 112. In operation, each sand control screen assembly 116 serves the primary function of filtering particulate matter out of the production fluid stream originating from the formation 110 such that particulates and other fines are not produced to the surface. Moreover, as described in more detail below, the flow control devices 120 may be actuatable and otherwise operable to regulate the flow of the fluids 122 into the completion string 114.

Regulating the flow of fluids 122 into the completion string 114 from each production interval may be advantageous in preventing water coning 124 or gas coning 126 in the subterranean formation 110. Other uses for flow regulation of the fluids 122 include, but are not limited to, balancing production from multiple production intervals, minimizing production of undesired fluids, maximizing production of desired fluids, etc. The flow control devices 120 described herein enable such benefits by providing a force-balanced flow controller that regulates the flow of the fluid 122 from the subterranean formation 110 to the interior of the completion string 114.

It should be noted that even though FIG. 1 depicts the sand control screen assemblies 116 as being arranged in an open hole portion of the wellbore 102, embodiments are contemplated herein where one or more of the sand control screen assemblies 116 is arranged within cased portions of the wellbore 102. Also, even though FIG. 1 depicts a single sand control screen assembly 116 arranged in each production interval, any number of sand control screen assemblies 116 may be deployed within a particular production interval without departing from the scope of the disclosure. In addition, even though FIG. 1 depicts multiple production intervals separated by the packers 118, any number of production intervals with a corresponding number of packers 118 may be used. In other embodiments, the packers 118 may be entirely omitted from the completion interval, without departing from the scope of the disclosure.

Furthermore, while FIG. 1 depicts the sand control screen assemblies 116 as being arranged in the horizontal section 106 of the wellbore 102, the sand control screen assemblies 116 are equally well suited for use in the vertical section 104 or portions of the wellbore 102 that are deviated, slanted, multilateral, or any combination thereof. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
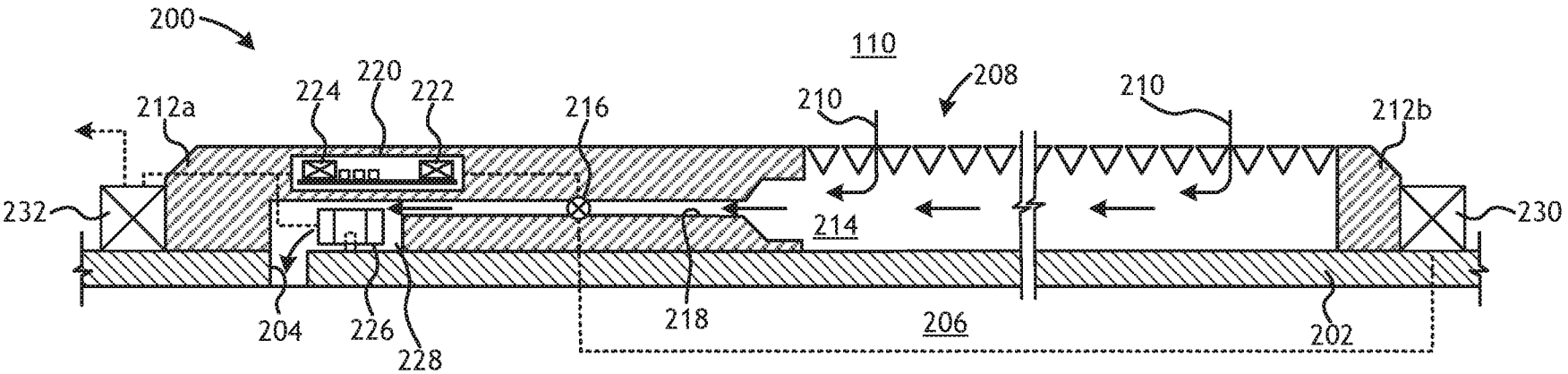
FIG. 2 is a cross-sectional schematic view of an exemplary sand control screen assembly.

FIG. 2 is a cross-sectional schematic view of an exemplary sand control screen assembly 200, according to one or more embodiments. The sand control screen assembly 200 (hereafter "the screen assembly 200") may be the same as or similar to any of the sand control screen assemblies 116 of FIG. 1 and, therefore, may be used in the well system 100 (FIG. 1). The screen assembly 200 may include or otherwise be arranged about a base pipe 202 that defines one or more openings or flow ports 204 that facilitate fluid communication between an interior 206 of the base pipe 202 and the surrounding subterranean formation 110. The base pipe 202 forms part of the completion string 114 (FIG. 1) and may coupled to or form an integral extension of the production tubing 112 (FIG. 1).

As illustrated, the screen assembly 200 may further include a sand screen 208 that extends about the exterior of the base pipe 202. The sand screen 208 and its various components serve as a filter medium designed to allow fluids 210 derived from the formation 110 to flow therethrough but prevent the influx of particulate matter of a predetermined size.

As illustrated, the sand screen 208 may generally extend between an upper end ring 212*a* arranged about the base pipe 202 at a first or uphole end and a lower end ring 212*b* arranged about the base pipe 202 at a second or downhole end. The upper and lower end rings 212*a,b* provide a mechanical interface between the base pipe 202 and the opposing axial ends of the sand screen 208. In one or more embodiments, however, the lower end ring 212*b* may be omitted and the sand screen 208 may alternatively be coupled directly to the base pipe 202 at its downhole end. Each end ring 212*a,b* may be formed from a metal, such as 13 chrome, 304L stainless steel, 316L stainless steel, 420 stainless steel, 410 stainless steel, INCOLOYO 825, iron, brass, copper, bronze, tungsten, titanium, cobalt, nickel, combinations thereof, or the like. Moreover, each end ring 212*a, b* may be secured to the outer surface of base pipe 202 by being welded, brazed, threaded, mechanically fastened, combinations thereof, or the like.

The sand screen 208 may be fluid-porous, particulate restricting device made from of a plurality of layers of a wire mesh that are diffusion bonded or sintered together to form a fluid-porous wire mesh screen. In other embodiments, however, the sand screen 208 may have multiple layers of a weave mesh wire material having a uniform pore structure and a controlled pore size that is determined based upon the properties of the formation 110. For example, suitable weave mesh screens may include, but are not limited to, a plain Dutch weave, a twilled Dutch weave, a reverse Dutch weave, combinations thereof, or the like. In other embodiments, however, the sand screen 208 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure. Moreover, in some embodiments, the sand screen 208 may be replaced with a slotted liner or other type of downhole filtration device.

As illustrated, the sand screen 208 may be radially offset a short distance from the base pipe 202 so that an annulus 214 is defined radially between the sand screen 208 and the base pipe 202. The annulus 214 forms part of a flow path for the fluids 210 to enter the interior 206 of the base pipe 202. More specifically, the flow path for the fluids 210 extends from the formation 110, through the sand screen 208, through the flow ports 204 defined in the base pipe 202, and into the interior 206 to be produced to the surface location via, for example, the production tubing 112 (FIG. 1). Accordingly, the flow path for the fluids 210 includes any portion of the aforementioned path or route.

The screen assembly 200 may further include a flow control device 216 positioned within the flow path and configured to receive a flow of the fluid 210 prior to entering the base pipe 202. In some embodiments, as illustrated, the flow control device 216 may be positioned within a channel or conduit 218 defined in the upper end ring 212*a* or another sub (not shown) included in the screen assembly 200. According to the present disclosure, and as is described in more detail below, the flow control device 216 may comprise a force-balanced flow controller that includes a pressure-balanced piston actuatable to regulate the flow of the fluid 210 along the flow path. The pressure-balanced piston is able to balance hydraulic forces within the flow control device 216 even when the flow control device 216 is only partially closed. Consequently, the pressure-balanced piston minimizes the power and size requirements of an actuator needed to actuate the flow control device 216 between open and closed positions. Moreover, the minimal power and size requirements for the actuator allows the pressure-balanced piston to be shifted based on a magnetic coupling, which eliminates the need for dynamic seals.

The screen assembly 200 may also include an electronics module 220 configured to monitor and operate the flow control device 216. Accordingly, the flow control device 216 may be communicably coupled (either wired or wirelessly) to the electronics module 220. In some embodiments, as illustrated, the electronics module 220 may be coupled to or secured within the upper end ring 212*a*. In other embodiments, however, the electronics module 220 may be included in the screen assembly 200 at another location, without departing from the scope of the disclosure.

The electronics module 220 may include, for example, computer hardware and/or software used to operate the flow control device 216 (and other components of the screen assembly 200, if needed). The computer hardware may include a processor 222 configured to execute one or more sequences of instructions, programming stances, or code stored on a non-transitory, computer-readable medium and can include, for example, a general purpose microprocessor, a microcontroller, a digital signal processor, or any like suitable device. In some embodiments, the electronics module 220 may further include a power source 224 that provides electrical power to the flow control device 216 (and other components of the screen assembly 200, if needed) for operation. The power source 224 may comprise, but is not limited to, one or more batteries, a fuel cell, a nuclear-based generator, a flow induced vibration power harvester, or any combination thereof.

In one or more embodiments, the power source 224 may be omitted from the electronics module 220 and electrical power required to operate the flow control device 216 (and other components of the screen assembly 200, if needed) may be obtained from a downhole power generator 226 included in the screen assembly 200. In the illustrated embodiment, the downhole power generator 226 is positioned within the flow path downstream from the flow control device 216 and otherwise configured to receive a flow of the fluid 210. In at least one embodiment, the downhole power generator 226 may comprise a transverse flow turbine assembly and, as illustrated, may be positioned within a cavity 228 defined in the upper end ring 212*a*. Alternatively, the downhole power generator 226 could be arranged in the flow path outside of the upper end ring 212*a* or at any point along the flow path, without departing from the scope of the disclosure.

As will be described in more detail below, the downhole power generator 226 may include a transverse turbine and an associated power generator. The transverse turbine may include a plurality of rotor blades configured to receive the fluid 210 from the flow path and convert the kinetic energy of the fluid 210 into rotational energy that generates electrical power in the power generator. The generated electrical power may be transferred to the electronics module 220 for power conditioning and rectification, or may otherwise be provided directly to the flow control device 216 (and other components of the screen assembly 200, if needed).

The screen assembly 200 may further include a sensor module 230 and a bi-directional communications module 232, each being communicably coupled (either wired or wirelessly) to the electronics module 220 to enable transfer of data and/or control signals to/from the electronics module 220. In some embodiments, however, the sensor module 230 may be directly coupled to the communications module 232, without departing from the scope of the disclosure. The power source 224 may be used to power one or both of the sensor module 230 and the communications module 232, but the downhole power generator 26 may alternatively be used to provide the required electrical power. While depicted in FIG. 2 as being arranged separately at opposing axial ends of the screen assembly 200, the sensor module 230 and the communications module 232 may alternatively be positioned adjacent one another or may form a single module or component.

The sensor module 230 may be configured to monitor or otherwise measure various wellbore parameters during operation of the screen assembly 200 and thereby obtain measurement data. The sensor module 230 may also include one or more transmitters and receivers used to communicate with the electronics module 220 (or the communications module 232) to provide measurement data. In at least one embodiment, the sensor module 230 may be configured to monitor the physical and chemical properties of the fluids 210 derived from the subterranean formation 110. Accordingly, the sensor module 230 may include a variety of sensors including, but not limited to, a radioactive sensor (e.g., gamma, neutron, and proton), a sonic emitter and receiver, an electromagnetic resistivity sensor, a sonic or acoustic sensor, a self/spontaneous potential sensor, a nuclear magnetic resonance logging sensor, a temperature sensor, a pressure sensors, a pH sensor, a density sensor, a viscosity sensor, a chemical composition sensor (e.g., sensors capable of determining the chemical makeup of the fluids 210 and otherwise capable of comparing chemical compositions of different fluids), a flow rate sensor, and the like.

The communications module 232 may be communicably coupled (either wired or wirelessly) to the electronics module 220 to enable transfer of data or control signals to/from the electronics module 220. The communications module 232 may further be communicably coupled to a well surface location (either wired or wirelessly) to enable transfer of data or control signals to/from the surface location during operation. Consequently, the communications module 232 may include one or more transmitters and receivers, for example, to facilitate bi-directional communication with the surface location. As a result, a well operator at the well surface location may be apprised of the real-time operational conditions of the screen assembly 200 and may be able to send command signals to the flow control device 216 to adjust and otherwise regulate the flow of the fluid 210 when desired.

In one example, the sensor module 230 may be configured to monitor an advancing waterfront in the formation 110 and obtain measurement data regarding the location and/or flow rate of the waterfront. The sensor module 230 may transmit the measurement data to the electronics module 220 for processing. In some embodiments, the electronics module 220 may convey the measurement data to the communications module 232 to be transmitted to a well operator at a well surface location for consideration. In response, the well operator may send one or more command signals to the electronics module 220 via the communications module 232 to instruct the flow control device 216 to adjust operation. In other embodiments, however, the electronics module 220 may receive the measurement data from the sensor module 230 and be programmed to autonomously regulate operation of the flow control device 216 to minimize production of undesired fluids 210. For instance, when the measurement data surpasses a measured predetermined threshold of operation, the electronics module 220 may be programmed to actuate the flow control device 216 and thereby limit the influx of undesired fluids 210. In yet other embodiments, the sensor module 230 may send the measurement data directly to the communications module 232 to be transmitted to the well operator for consideration. In such embodiments, if desired or warranted, the well operator may respond with a command signal to adjust operation of the flow control device 216.

Figure 3:
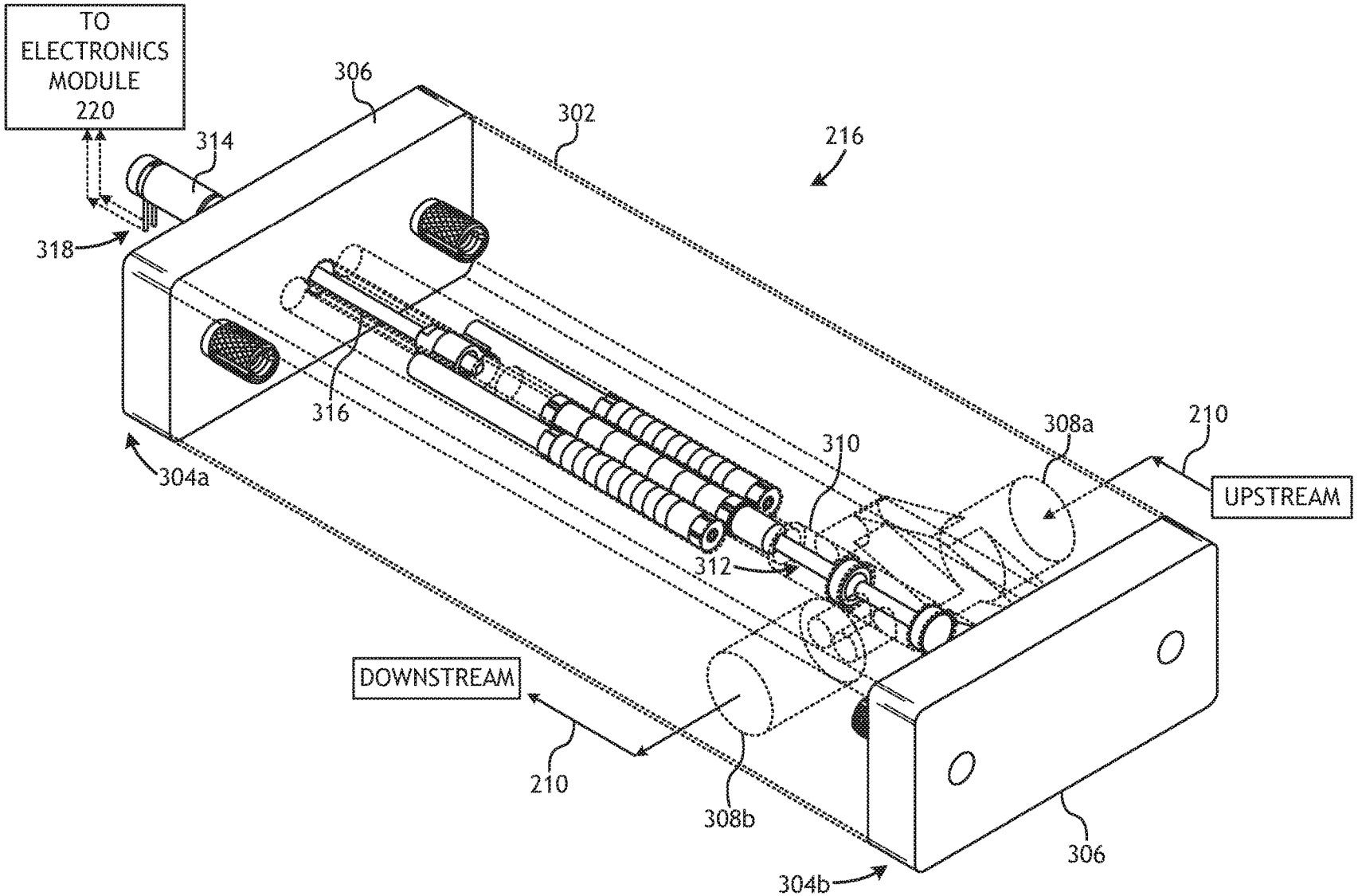
FIG. 3 is an isometric view of an exemplary embodiment of the flow control device of FIG. 2.

FIG. 3 is an isometric view of an exemplary embodiment of the flow control device 216 of FIG. 2, according to one or more embodiments. As illustrated, the flow control device 216 may include a housing 302 having a first end 304*a* and a second end 304*b* opposite the first end 304*a*. An end cap 306 may be coupled to the housing 302 at each end 304*a,b* and removable to allow an operator to access the internal components of the flow control device 216. While depicted in FIG. 3 as generally rectangular in shape, the housing 302 may alternatively exhibit other shapes, such as any polygonal or cylindrical shape, without departing from the scope of the disclosure.

The housing 302 defines an inlet 308*a* that fluidly communicates with a piston chamber 310 defined within the housing 302. The inlet 308*a* may be configured to receive a flow of the fluid 210 from the conduit 218 (FIG. 2) and otherwise upstream from the flow control device 216, as shown in the screen assembly 200 of FIG. 2. The housing 302 also defines an outlet 308*b* that fluidly communicates with the piston chamber 310. Fluid 210 exiting the flow control device 216 via the outlet 308*b* may enter the conduit 218 downstream from the flow control device 216, as shown in the screen assembly 200 of FIG. 2.

A pressure-balanced piston 312 is movably positioned within the piston chamber 310 and movable between a first or closed position, where the pressure-balanced piston 312 substantially prevents fluid flow through the piston chamber 310 between the inlet 308*a* and the outlet 308*b*, and a second or open position, where fluid flow around the pressure-balanced piston 312 and through the piston chamber 310 is facilitated. The pressure-balanced piston 312 may be moved between the closed and open positions with an actuator 314 at least partially positioned within an actuator chamber 316 defined within the housing 302. As described below, the actuator 314 may be operatively coupled to the pressure-balanced piston 312 such that axial movement of the actuator 314 within the actuator chamber 316 correspondingly moves the pressure-balanced piston 312 within the piston chamber 310. As used herein, the term "operatively coupled" refers to a direct or indirect coupled engagement between two component parts.

The actuator 314 may comprise a linear actuator such as, but not limited to, a mechanical actuator (e.g., a piston and solenoid, a screw-thread actuator, a wheel and axle actuator, a cam actuator, etc.), a hydraulic actuator, a pneumatic actuator, a piezoelectric actuator, an electro-mechanical actuator (e.g., a brush or brushless motor driving a gear box), a linear motor, a telescoping linear actuator, any combination thereof, or any low force (i.e., low power consumption) linear actuator. The actuator 314 may be communicably coupled to the electronics module 220 (FIG. 2) via one or more leads 318 (two shown) to facilitate power and signal transfer.

Figure 4A:
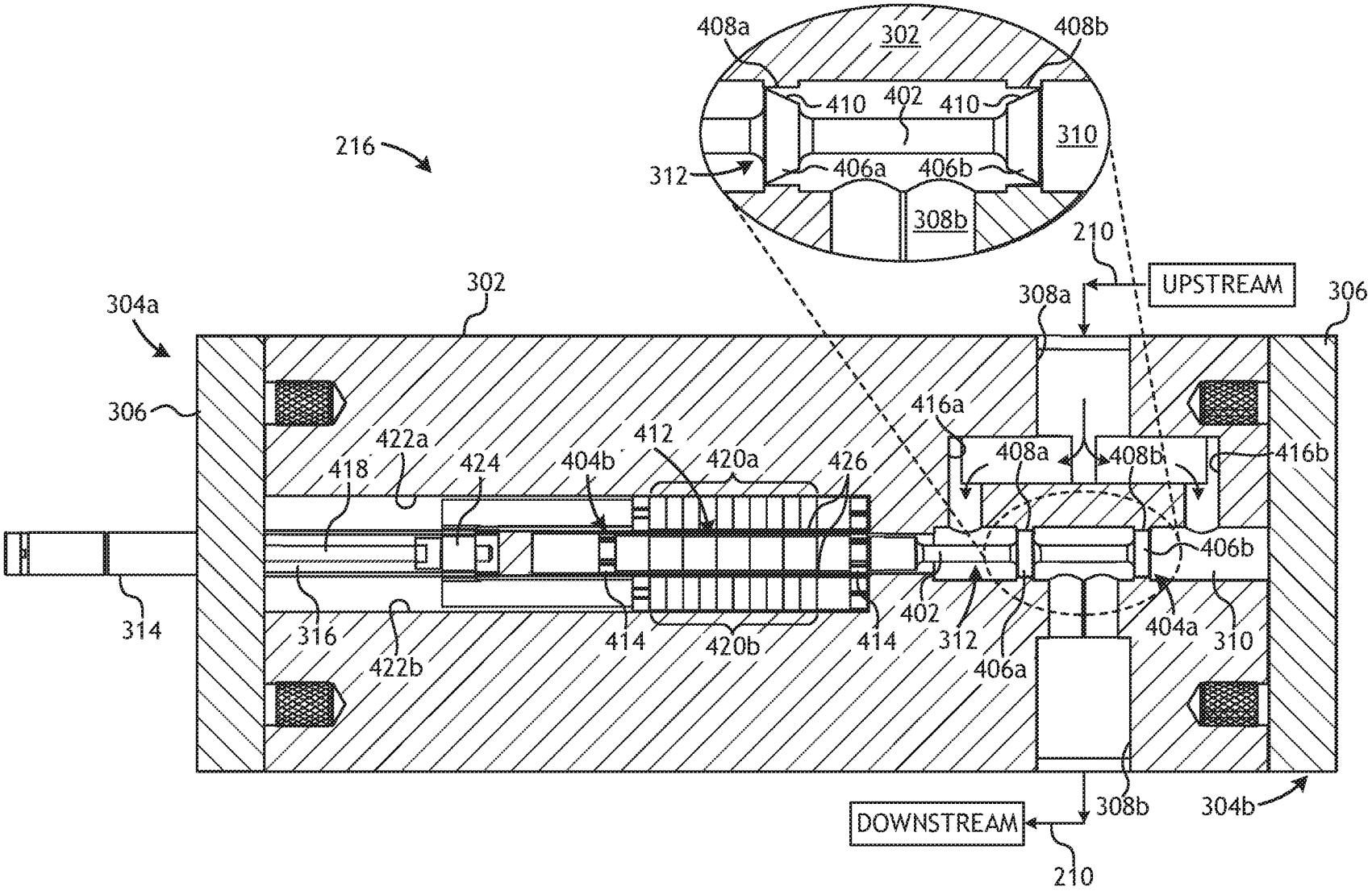
FIGS. 4A and 4B are partial cross-sectional top views of the flow control device of FIG. 3.
Figure 4B:
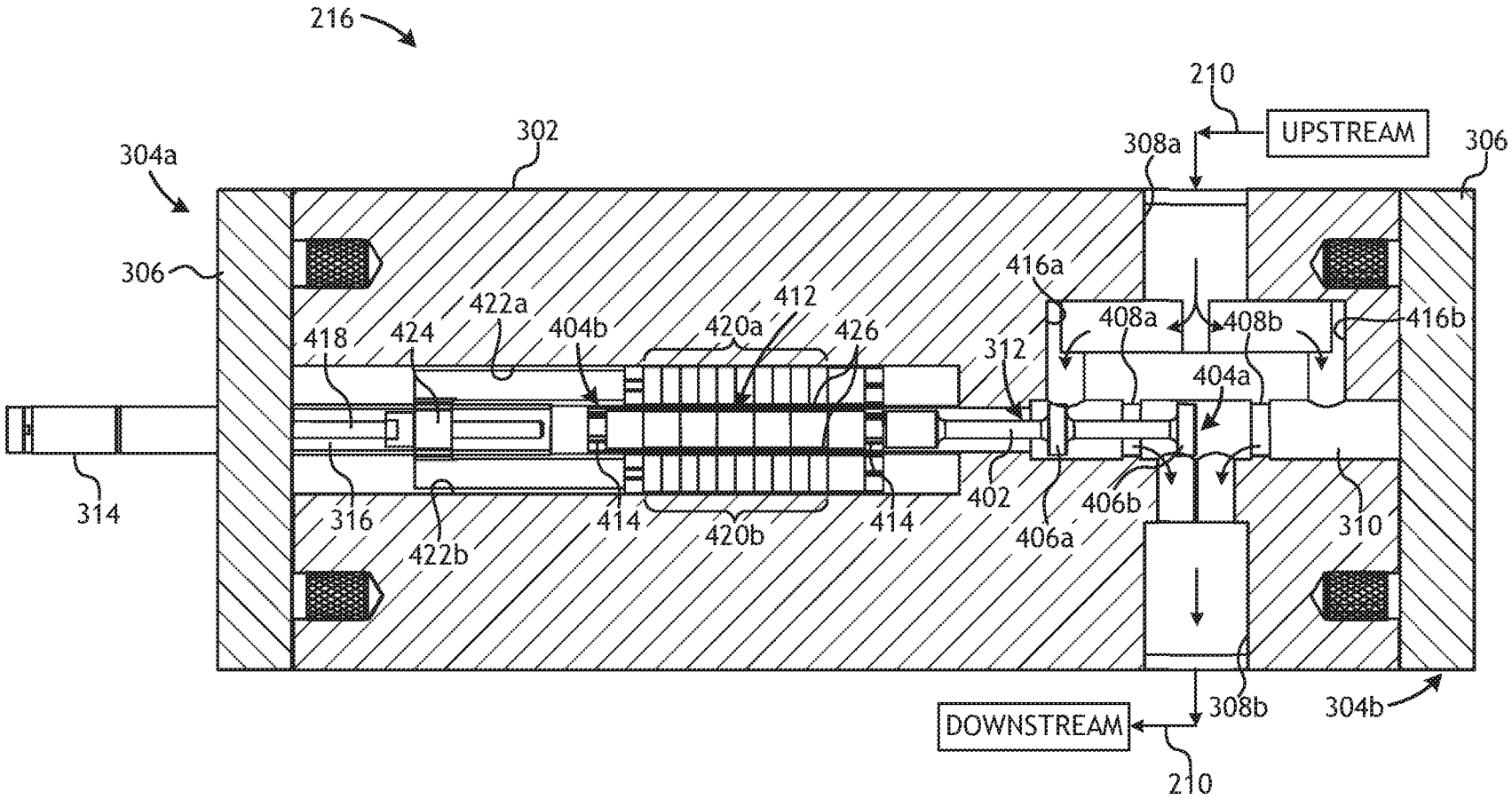

FIGS. 4A and 4B are partial cross-sectional top views of the flow control device 216 of FIG. 3. FIG. 4A shows the pressure-balanced piston 312 in the closed position, and FIG. 4B shows the pressure-balanced piston 312 moved within the piston chamber 310 to the open position. As illustrated, the pressure-balanced piston 312 may include a piston rod 402 having a first end 404*a* and a second end 404*b* opposite the first end 404*a*. At or near the first end 404*a*, the pressure-balanced piston 312 may include a first piston head 406*a* axially spaced from a second piston head 406*b* and each coupled to the piston rod 402 or otherwise forming an integral part thereof.

The piston chamber 310 may define a first choke point 408*a* and a second choke point 408*b* axially spaced from the first choke point 408*a*. In the illustrated embodiment, the first and second choke points 408*a,b* each provide a reduced diameter portion of the piston chamber 310 configured to radially engage the first and second piston heads 406*a,b* when the pressure-balanced piston 312 is in the closed position. Accordingly, the first and second piston heads 406*a,b* may be axially spaced from each other along the piston rod 402 to axially align with the first and second choke points 408*a,b*.

The first and second piston heads 406*a,b* exhibit similar cross-sectional flow areas and may be sized to sealingly engage the first and second choke points 408*a,b*, respectively, when the pressure-balanced piston 312 is in the closed position. In some embodiments, however, the first and second piston heads 406*a,b* may be sized to allow a small amount of fluid leakage past the first and second choke points 408*a,b*, respectively, when the pressure-balanced piston 312 is in the closed position. It is noted that the first and second piston heads 406*a,b* may exhibit similar cross-sectional flow areas, but may or may not be exactly equal, such as what would be achieved with tight machining tolerances. Rather, the cross-sectional flow areas of the first and second piston heads 406*a,b* may vary as a result of damage or manufacturing inconsistencies. In some applications, for example, the cross-sectional flow areas of the first and second piston heads 406*a,b* may be within a 10% tolerance range of each other, but could alternatively be within a tolerance range less than or greater than 10%, without departing from the scope of the disclosure.

In some embodiments, one or both of the first and second piston heads 406*a* may exhibit a rectangular cross-sectional area. In such embodiments, the rectangular cross-sectional area could be elongated to provide additional fluid friction since a longer rectangular cross-section would allow for a larger gap between the piston head 406*a,b* and the corresponding choke point 408*a,b*. In other embodiments, however, as is shown in the enlarged view of FIG. 4A, the first and second piston heads 406*a,b* may exhibit a cross-sectional area having a tapered surface 410 that is angled from the upstream to the downstream side of each piston head 406*a,b* and otherwise toward the outlet 308*b*. As a result, the first and second piston heads 406*a,b* may exhibit a larger diameter on the upstream side as compared to the downstream side. This may prove advantageous in helping clear sand and other debris that may circulate through the piston chamber 310 during operation. In some embodiments, the gap between the piston head 406*a,b* and the corresponding choke point 408*a,b* may be filled with a elastomeric or plastic seal, such as an O-ring or a plastic seal positioned on the outer diameter of one or both of the piston heads 406*a,b* or on the inner diameter of one or both of the choke points 408*a,b*.

The pressure-balanced piston 312 may also include one or more follower magnets 412. In the illustrated embodiment, the follower magnets 412 may be positioned at or near the second end 404*b* of the piston rod 402. The pressure-balanced piston 312, as illustrated, includes five follower magnets 412, but could alternatively include more or less than five, without departing from the scope of the disclosure. The follower magnets 412 may be fixed to the piston rod 402, such as being axially secured to the piston rod 402 between upper and lower linear bearings 414. As the pressure-balanced piston 312 is actuated between the closed and open positions, the linear bearings 414 may engage the inner wall of the piston chamber 310 and help facilitate axial translation of the pressure-balanced piston 312 without obstruction. In some embodiments, the linear bearings 414 may comprise nylon bearings, but could alternatively comprise TEFLON® or carbide bearings, which may prove advantageous in corrosion and/or wear resistance.

As illustrated, the inlet 308*a* to the piston chamber 310 separates and otherwise splits into a first branch 416*a* and a second branch 416*b*. The first branch 416*a* communicates with the piston chamber 310 upstream from the first choke point 408*a* and the second branch 416*b* communicates with the piston chamber 310 upstream from the second choke point 408*b*. When the pressure-balanced piston 312 is in the closed position, as shown in FIG. 4A, the fluid 210 entering the flow control device 216 via the inlet 308*a* separates into the first and second branches 416*a,b* and impinges on the upstream ends of the first and second piston heads 406*a,b*, respectively. The fluid 210 impinging on the upstream end of the first piston head 406*a* generates a pressure differential across the first piston head 406*a* and thereby urges the pressure-balanced piston 312 to the right in FIGS. 4A-4B. The fluid impinging on the upstream end of the second piston head 406*b* generates a pressure differential across the second piston head 406*b* and thereby urges the pressure-balanced piston 312 to the left in FIGS. 4A-4B. Since the cross-sectional flow areas of the first and second piston heads 406*a,b* are substantially similar, the hydraulic force acting on each piston head 406*a,b* are also substantially similar. Additionally, since the flow paths impinging on the piston heads 406*a,b* are in opposite directions, the net hydraulic force acting upon the pressure-balanced piston 312 is zero. As a result, only a minimal axial force will be required to move the pressure-balanced piston 312 to the open position.

The actuator 314 is operatively coupled to the pressure-balanced piston 312 such that axial movement of the actuator 314 within the actuator chamber 316 correspondingly moves the pressure-balanced piston 312 within the piston chamber 310. More particularly, the actuator 314 may include an actuator rod 418 extended longitudinally within the actuator chamber 316 and coupled to one or more sets of drive magnets 420. In the illustrated embodiment, the drive magnets 420 are depicted as including a first set of drive magnets 420*a* extending longitudinally within a first drive magnet chamber 616*a* and a second set of drive magnets 420*b* extending longitudinally within a second drive magnet chamber 616*b*.

The first and second sets of drive magnets 420*a,b* may be coupled to the actuator rod 418 with a coupling 424, such as a dual pronged coupling operable to extend into the first and second drive magnet chambers 422*a,b*. As illustrated, the first and second drive magnet chambers 422*a,b* are defined on opposing lateral sides of the piston chamber 310 and angularly spaced from each other by 180°. Moreover, the first and second drive magnet chambers 422*a,b* are offset from the piston chamber 310 such that a wall 426 of the housing 302 interposes the piston chamber 310 and the first and second drive magnet chambers 422*a,b*. The wall 426 isolates the actuator 314 and the first and second sets of drive magnets 420*a,b* from the fluid 210 flowing through the piston chamber 310 and, therefore, prevents dirt and debris often included in the fluid 210 from damaging or adversely affecting the actuator 314 and the first and second sets of drive magnets 420*a,b*.

The first and second sets of drive magnets 420*a,b* may be configured to be magnetically coupled to the follower magnets 412. As a result, any axial movement of the first and second sets of drive magnets 420*a,b* within the first and second drive magnet chambers 422*a,b* correspondingly moves the follower magnets 412 within the piston chamber 310. Accordingly, actuating the actuator 314 will result in movement of the pressure-balanced piston 312. The follower magnets 412 and the drive magnets 420 may comprise any mutually attractive magnetic material including, but not limited to, permanent magnets, such as alnico magnets or rare earth magnets (e.g., neodymium and samarium-cobalt magnets). In at least one embodiment, the magnetic coupling between the follower magnets 412 and the first and second sets of drive magnets 420*a,b* may be arranged as a Halbach array.

While ten magnets are shown as being included in each set of drive magnets 420*a,b*, more or less than ten magnets could alternatively be employed, without departing from the scope of the disclosure. Moreover, while two sets of drive magnets 420*a,b* are depicted in FIGS. 4A-4B, more or less than two sets (including only one set) may be employed, without departing from the scope of the disclosure. When multiple sets of drive magnets 420*a,b* are used, however, they may be equidistantly spaced about the follower magnets 412 to balance friction forces that may be assumed by the linear bearings 414 during operation. More specifically, the drive magnets 420 create a magnetic side thrust on the follower magnets 412, which can urge the linear bearings 414 into engagement with the inner wall of the piston chamber 310. By using pairs or multiple sets of equidistantly spaced drive magnets 420*a,b*, the bearing friction on the follower magnets 412 is reduced or eliminated, which may be advantageous if the fluids 210 affect the surface roughness of the linear bearings 414 over time.

Exemplary operation of the flow control device 216 shown in FIGS. 4A-4B is now provided. Fluid 210 may enter the flow control device 216 from an upstream location at the inlet 308*a* and flow toward the piston chamber 310. The flow of the fluid 210 separates into the first and second branches 416*a,b* and flows toward the upstream ends of the first and second piston heads 406*a,b*, respectively. When the pressure-balanced piston 312 is in the closed position, as shown in FIG. 4A, the fluid 210 impinges on the respective upstream ends of the first and second piston heads 406*a,b* and a balanced hydraulic pressure differential is thereby generated across the piston heads 406*a,b* in opposing axial directions within the piston chamber 310. As a result, there are no net hydraulic forces acting on the pressure-balanced piston 312.

The actuator 314 may then be actuated to move the pressure-balanced piston 312 toward the open position, as shown in FIG. 4B. Upon actuating the actuator 314, the actuator rod 418 is drawn to the left in FIGS. 4A-4B, which correspondingly draws the first and second sets of drive magnets 420*a,b* in the same direction within the first and second drive magnet chambers 422*a,b*, respectively. Since the first and second sets of drive magnets 420*a,b* are magnetically coupled to the follower magnets 412, the follower magnets 412 correspondingly move to the left within the piston chamber 310 as the first and second sets of drive magnets 420*a,b* move to the left, which moves the pressure-balanced piston 312 in the same direction. Moving the pressure-balanced piston 312 to the left moves the piston heads 406*a,b* out of engagement with and otherwise away from the first and second choke points 408*a,b*, which allows the fluid 210 to bypass the choke points 408*a,b* and flow toward the outlet 308*b*. The forces on the pressure-balanced piston 312 are balanced even when the pressure-balanced piston 312 is only partially closed/open. Fluid 210 exiting the flow control device 216 via the outlet 308*b* may enter the conduit 218 (FIG. 2) downstream from the flow control device 216, as shown in the screen assembly 200 of FIG. 2.

Since the pressure-balanced piston 312 is hydraulically balanced via the first and second branches 416*a,b*, the axial force or load required to move the pressure-balanced piston 312 is greatly minimized. This allows the magnetic coupling between the follower magnets 412 and the first and second sets of drive magnets 420*a,b* to become a viable and effective option in moving the pressure-balanced piston 312. Moreover, using a magnetic coupling eliminates the need for dynamic seals, which can fail when exposed to caustic and abrasive downhole fluids for long periods. Furthermore, with a reduced axial force requirement to shift the pressure-balanced piston 312, the actuator 314 may be smaller in size and/or otherwise consume less power as compared to conventional downhole valve actuators.

While operation of the flow control device 216 in FIGS. 4A-4B shows the actuator 314 moving the actuator rod 418 to the left and thereby drawing the first and second sets of drive magnets 420*a,b* and the follower magnets 412 in the same direction, this direction is by example only. In other embodiments, for instance, the actuator 314 may alternatively move the actuator rod 418 to the right in FIGS. 4A-4B to move the pressure-balanced piston 312 from the closed position to the open position. Accordingly, as indicated above, use of directional terms such as left and right are merely used in relation to the illustrative embodiments as they are depicted in the figures. The use of directional terms "left" and "right" may alternatively by characterized as a "first direction" and a "second direction," where the first direction is opposite the second direction.

Figure 5:
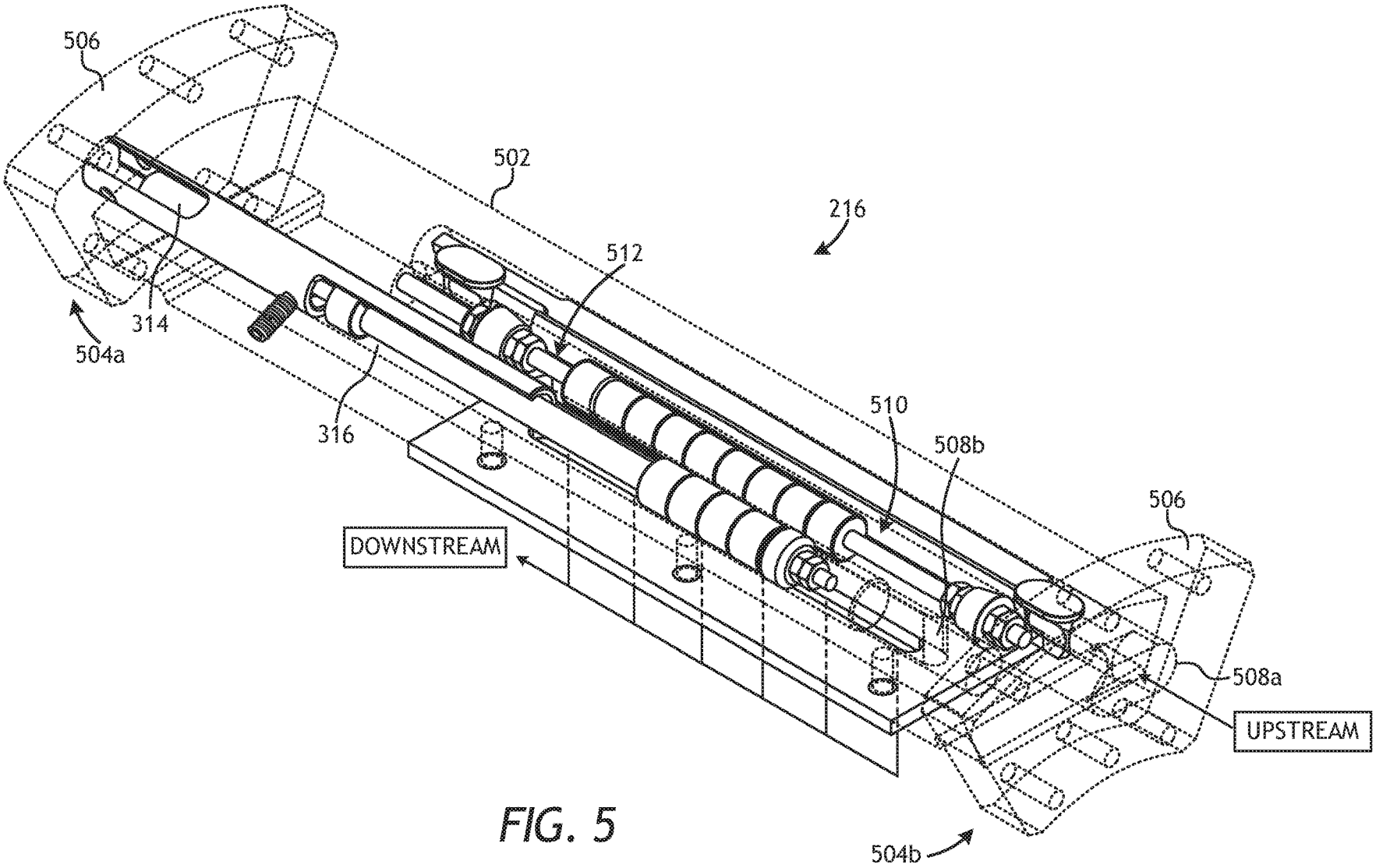
FIG. 5 is an isometric view of another exemplary embodiment of the flow control device of FIG. 2.

FIG. 5 is an isometric view of another exemplary embodiment of the flow control device 216 of FIG. 2, according to one or more embodiments. The embodiment shown in FIG. 5 may be similar in some respects to the embodiment of FIG. 3 and therefore may be best understood with reference thereto, where like numerals represent like elements or components not described again in detail. As illustrated, the flow control device 216 may include a housing 502 having a first end 504*a* and a second end 504*b* opposite the first end 504*a*. End caps 506 may be coupled to the housing 502 at each end 504*a,b* and removable to allow an operator to access the internal components or areas of the flow control device 216.

The housing 502 defines an inlet 508*a* that fluidly communicates with a piston chamber 510 defined within the housing 502. Unlike the inlet 308*a* of the embodiment shown in FIG. 3, however, the inlet 508*a* is defined axially through the end cap 506 at the second end 504*b* of the housing 510. The inlet 508*a* receives a flow of the fluid 210 from the conduit 218 (FIG. 2) and otherwise upstream from the flow control device 216, as shown in the screen assembly 200 of FIG. 2. The housing 502 also defines an outlet 508*b* that fluidly communicates with the piston chamber 510. Unlike the outlet 308*b* of the embodiment shown in FIG. 3, however, the outlet 508*b* comprises a slot defined through the housing 502 from the piston chamber 510 toward the bottom of the housing 502. Accordingly, the fluid 210 enters the housing 502 axially via the inlet 508*a*, but exits radially from the bottom of the housing 502 via the piston chamber 510 and the outlet 508*b*. The fluid 210 exiting via the outlet 508*b* may enter the conduit 218 downstream from the flow control device 216, as shown in the screen assembly 200 of FIG. 2.

A pressure-balanced piston 512 is movably positioned within the piston chamber 510 and movable between a first or closed position, where the pressure-balanced piston 512 substantially prevents fluid flow through the piston chamber 510 between the inlet 508*a* and the outlet 508*b*, and a second or open position, where fluid flow around the pressure-balanced piston 512 and through the piston chamber 510 is facilitated. The pressure-balanced piston 512 may be moved between the closed and open positions with the actuator 314 at least partially positioned within the actuator chamber 316 defined within the housing 502.

Figure 6A:
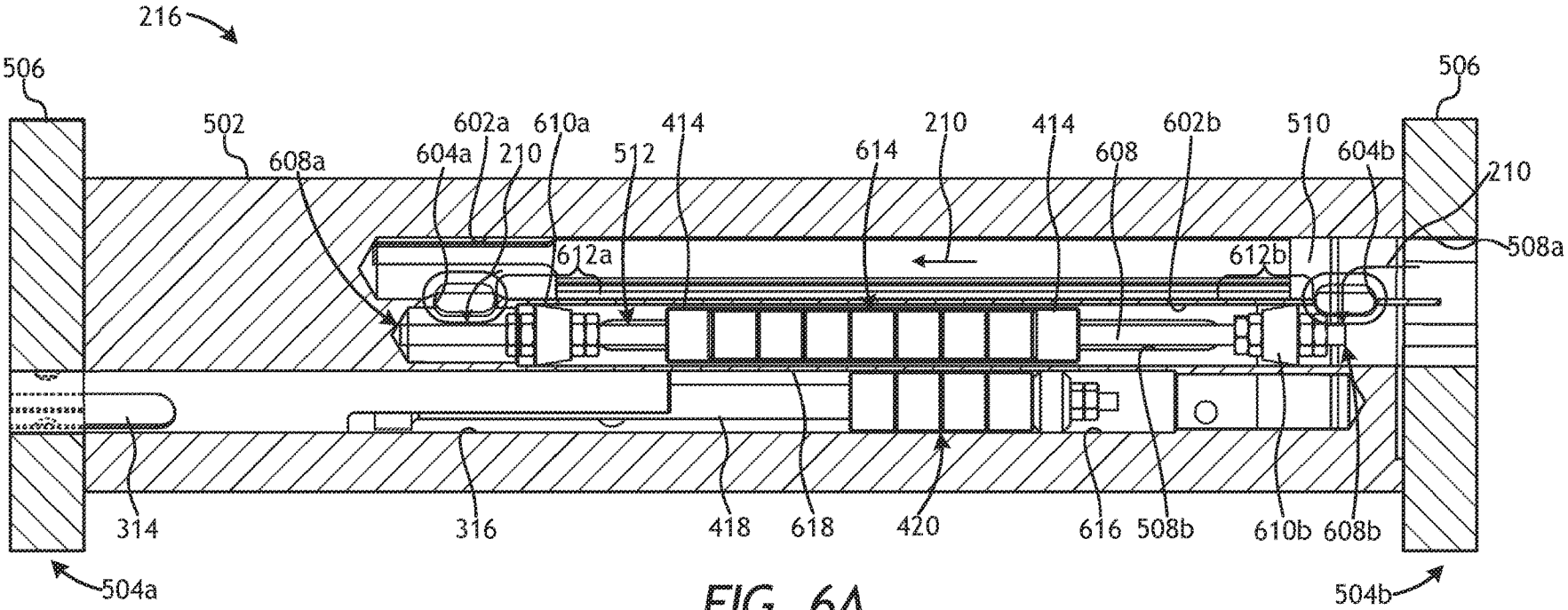
FIGS. 6A and 6B are partial cross-sectional top views of the flow control device of FIG. 5.
Figure 6B:
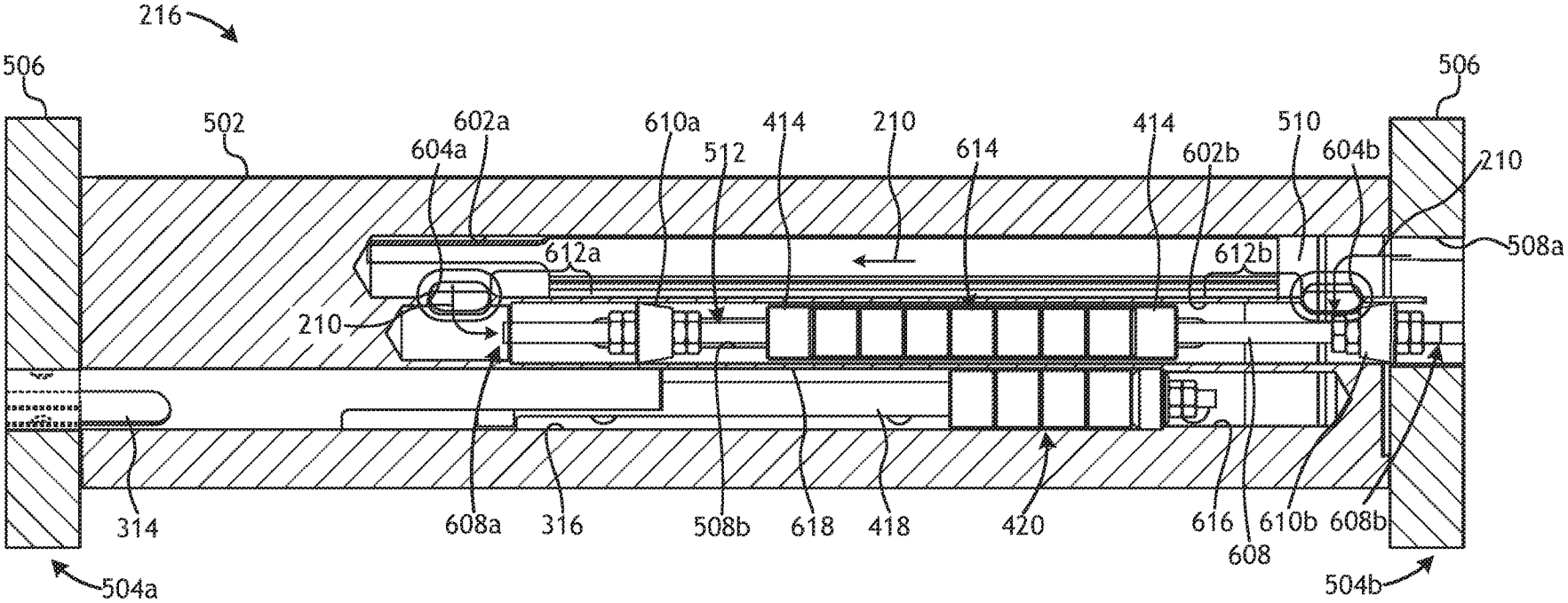

FIGS. 6A and 6B are partial cross-sectional top views of the flow control device 216 of FIG. 5. FIG. 6A shows the pressure-balanced piston 512 in the closed position, and FIG. 6B shows the pressure-balanced piston 512 moved within the piston chamber 510 to the open position. The piston chamber 510 may provide and otherwise define an inlet chamber 602*a* and an outlet chamber 602*b*, and the pressure-balanced piston 512 is movably positioned within the outlet chamber 602*b*. The inlet chamber 602*a* may extend axially into the housing 502 from the inlet 508*a* and the outlet chamber 602*b* may be defined within the housing 502 substantially parallel to the inlet chamber 602*a* and fluidly coupled to the inlet chamber 602*a* via a first branch 604*a* and a second branch 604*b*. The first and second branches 610*a,b* are flow passageways or conduits defined in the housing 502 that facilitate fluid communication between the inlet and outlet chambers 602*a,b*.

The pressure-balanced piston 512 may include a piston rod 606 having a first end 608*a* and a second end 608*b* opposite the first end 608*a*. The pressure-balanced piston 512 may include a first piston head 610*a* at or near the first end 608*a* and a second piston head 610*b* at or near the second end 608*b*. The first and second piston heads 610*a,b* may be coupled to the piston rod 606 or otherwise form an integral part thereof. In the illustrated embodiment, the first and second piston heads 610*a,b* are mechanically secured to the piston rod 606 using one or more mechanical fasteners (e.g., threaded nuts).

The outlet chamber 602*b* of the piston chamber 510 may define a first choke point 612*a* and a second choke point 612*b* axially spaced from the first choke point 612*a*. The first choke point 612*a* extends axially between the first branch 604*a* and the outlet 508*b*, and the second choke point 612*b* extends axially between the second branch 604*b* and the outlet 508*b*. The pressure-balanced piston 512 will be considered in the closed position when the first and second piston heads 610*a,b* overlap (i.e., are located axially within) the first and second choke points 612*a,b*, respectively. Accordingly, the first and second piston heads 610*a,b* may be axially spaced from each other along the piston rod 606 to axially align simultaneously with the first and second choke points 612*a,b*.

The first and second piston heads 610*a,b* exhibit similar cross-sectional flow areas and may be sized to sealingly engage the first and second choke points 612*a,b*, respectively, when the pressure-balanced piston 512 is in the closed position. In some embodiments, however, the first and second piston heads 610*a,b* may be sized to allow a small amount of fluid leakage past the first and second choke points 612*a,b*, respectively, when the pressure-balanced piston 512 is in the closed position. While the first and second piston heads 610*a,b* may exhibit similar cross-sectional flow areas, but may or may not be exactly equal, such as what would be achieved with tight machining tolerances. Rather, the cross-sectional flow areas of the first and second piston heads 610*a,b* may vary as a result of damage or manufacturing inconsistencies. In some applications, for example, the cross-sectional flow areas of the first and second piston heads 610*a,b* may be within a 10% tolerance range of each other, but could alternatively be within a tolerance range less than or greater than 10%, without departing from the scope of the disclosure.

In some embodiments, one or both of the first and second piston heads 610*a* may exhibit a rectangular cross-sectional area. In other embodiments, however, as illustrated, the first and second piston heads 610*a,b* may be tapered and otherwise angled toward the outlet 508*b*. As a result, the upstream side of each of the first and second piston heads 610*a,b* may exhibit a larger diameter as compared to the downstream side. This may prove advantageous in helping clear sand and other debris that may circulate through the piston chamber 510 during operation.

One or more follower magnets 614 may be positioned on the piston rod 606 and axially interposing the first and second piston heads 610*a,b*. In the illustrated embodiment, the pressure-balanced piston 512 includes seven follower magnets 614, but could alternatively include more or less than seven, without departing from the scope of the disclosure. The follower magnets 614 may be fixed to the piston rod 606, such as being axially secured to the piston rod 606 between upper and lower linear bearings 414. As the pressure-balanced piston 512 is actuated between the closed and open positions, the linear bearings 414 may engage the inner wall of the piston chamber 510 (i.e., the outlet chamber 602*b*) and help facilitate axial translation of the pressure-balanced piston 512 without obstruction.

The first branch 604*a* communicates with the piston chamber 510 (i.e., the outlet chamber 602*b*) upstream from the first choke point 612*a* and the second branch 604*b* communicates with the piston chamber 510 (i.e., the outlet chamber 602*b*) upstream from the second choke point 612*b*. When the pressure-balanced piston 512 is in the closed position, as shown in FIG. 6A, the fluid 210 entering the flow control device 216 via the inlet 508*a* separates into the first and second branches 610*a,b* and impinges on the upstream ends of the first and second piston heads 610*a,b*, respectively. The fluid 210 impinging on the upstream end of the first piston head 610*a* generates a pressure differential across the first piston head 610*a* and thereby urges the pressure-balanced piston 512 to the right in FIGS. 6A-6B. The fluid impinging on the upstream end of the second piston head 610*b* generates a pressure differential across the second piston head 610*b* and thereby urges the pressure-balanced piston 512 to the left in FIGS. 6A-6B. Since the cross-sectional flow areas of the first and second piston heads 610*a,b* are substantially similar, the hydraulic pressure loads acting on the pressure-balanced piston 512 are equally balanced such that there are no net hydraulic forces acting on the pressure-balanced piston 512. As a result, only a minimal axial force will be required to move the pressure-balanced piston 512 to the open position.

The actuator 314 is operatively coupled to the pressure-balanced piston 512 such that axial movement of the actuator rod 418 within the actuator chamber 316 correspondingly moves the pressure-balanced piston 512 within the piston chamber 510 (i.e., the outlet chamber 602*b*). More particularly, the actuator 314 includes one or more drive magnets 420 coupled to the actuator rod 418 and movable within a drive magnet chamber 616. In the illustrated embodiment, the drive magnet chamber 616 and the actuator chamber 316 are contiguous and otherwise coaxial with one another. Moreover, the drive magnet chamber 616 is offset from the piston chamber 510 (i.e., the outlet chamber 602*b*) such that a wall 618 of the housing 502 interposes the piston chamber 510 (i.e., the outlet chamber 602*b*) and the drive magnet chamber 616. This may be advantageous in isolating the actuator 314 and the drive magnet(s) 420 from the fluid 210 flowing through the piston chamber 510.

The drive magnet(s) 420 may be configured to be magnetically coupled to the follower magnets 614. As a result, any axial movement of the drive magnet(s) 420 within the drive magnet chamber 616 correspondingly moves the follower magnets 614 within the piston chamber 510 (i.e., the outlet chamber 602*b*), which moves the pressure-balanced piston 512. Accordingly, actuating the actuator 314 will result in movement of the pressure-balanced piston 512. In at least one embodiment, the magnetic coupling between the follower magnets 614 and the drive magnet(s) 420 may be arranged as a Halbach array.

While four magnets are shown as included in the drive magnet(s) 420, more or less than four magnets could alternatively be employed, without departing from the scope of the disclosure. Moreover, while only one set of drive magnet(s) 420 are depicted in FIGS. 6A and 6B, more than one set may be employed, without departing from the scope of the disclosure. The follower magnets 614 and the drive magnet(s) 420 may comprise any mutually attractive magnetic material including, but not limited to, permanent magnets, such as alnico magnets or rare earth magnets (e.g., neodymium and samarium-cobalt magnets).

Exemplary operation of the flow control device 216 shown in FIGS. 6A-6B is now provided. Fluid 210 may enter the flow control device 216 from an upstream location at the inlet 508*a* and flow toward the piston chamber 510. The flow of the fluid 210 separates into the first and second branches 610*a,b* and flows toward the upstream ends of the first and second piston heads 610*a,b*, respectively. When the pressure-balanced piston 512 is in the closed position, as shown in FIG. 6A, the fluid 210 impinges on the upstream ends of the first and second piston heads 610*a,b* and a balanced hydraulic pressure differential is generated across the piston heads 610*a,b* in opposing axial directions within the piston chamber 510 (i.e., the outlet chamber 602*b*). As a result, there are no net hydraulic forces acting on the pressure-balanced piston 512.

The actuator 314 may then be actuated to move the pressure-balanced piston 512 toward the open position, as shown in FIG. 6B. Upon actuating the actuator 314, the actuator rod 418 is moved to the right in FIGS. 6A-6B, which correspondingly moves the drive magnet(s) 420 in the same direction within the drive magnet chamber 616. Since the drive magnet(s) 420 are magnetically coupled to the follower magnets 614, as move the drive magnet(s) 420 move to the right the follower magnets 614 correspondingly move to the right within the piston chamber 510 (i.e., the outlet chamber 602*b*), which moves the pressure-balanced piston 512 in the same direction. Moving the pressure-balanced piston 512 to the right moves the piston heads 610*a,b* out of engagement with and otherwise away from the first and second choke points 612*a,b*, which exposes the outlet 508*b* and allows the fluid 210 to bypass the choke points 612*a,b* and flow into the outlet 508*b*. The hydraulic forces on the pressure-balanced piston 512 are balanced even when the pressure-balanced piston 512 is only partially closed/open. Fluid 210 exiting the flow control device 216 via the outlet 508*b* may enter the conduit 218 (FIG. 2)

downstream from the flow control device 216, as shown in the screen assembly 200 of FIG. 2.

While operation of the flow control device 216 in FIGS. 6A-6B shows the actuator 314 moving the actuator rod 418 to the right and thereby moving the drive magnet(s) 420 and the follower magnets 412 in the same direction, this direction is by example only. In other embodiments, for instance, the actuator 314 may alternatively move the actuator rod 418 to the left in FIGS. 6A-6B to move the pressure-balanced piston 312 from the closed position to the open position. Accordingly, as indicated above, the use of directional terms such as left and right are merely used in relation to the illustrative embodiments as they are depicted in the figures. The use of directional terms "left" and "right" may alternatively by characterized as a "first direction" and a "second direction," where the first direction is opposite the second direction.

Figure 7:
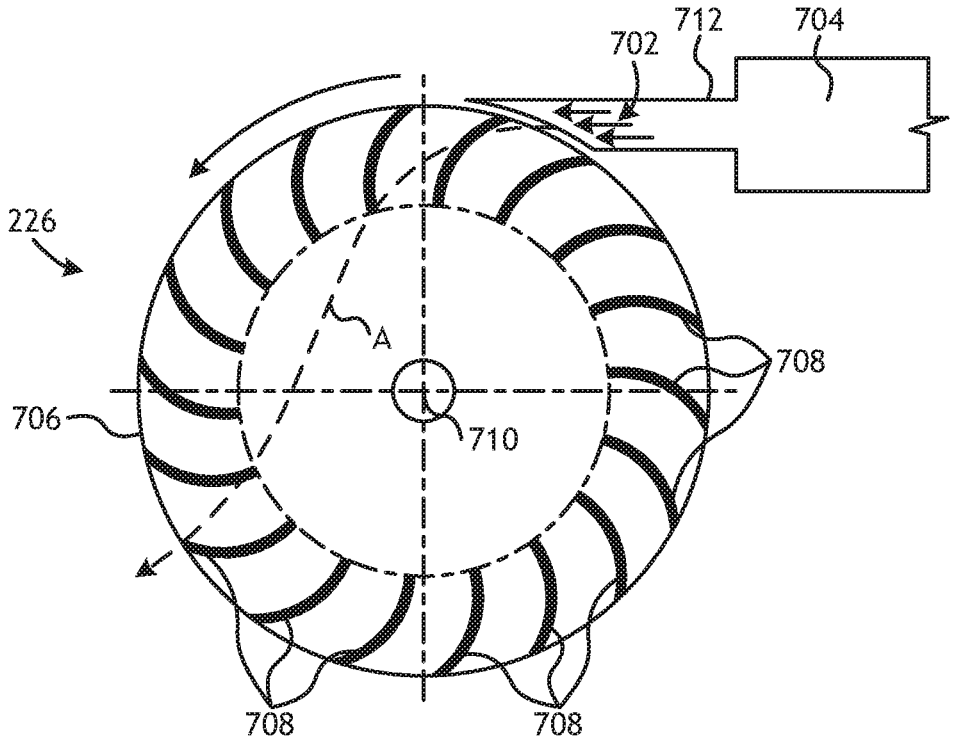
FIG. 7 is a schematic diagram of an exemplary embodiment of the downhole power generator of FIG. 2.

FIG. 7 is a schematic diagram of an exemplary embodiment of the downhole power generator 226 of FIG. 2, according to one or more embodiments. The downhole power generator 226 may be characterized as a transverse flow turbine configured to receive a flow of a fluid 702 from a flow path 704 and convert the kinetic energy and potential energy of the fluid 702 into rotational energy that generates electrical power. The flow path 704 may be, for example, a portion of the conduit 218 shown in FIG. 2.

The downhole power generator 226 may include a transverse turbine 706 having a plurality of blades 708 disposed thereabout and configured to receive the fluid 702. As the fluid 702 impinges upon the blades 708, the transverse turbine 706 is urged to rotate about a rotational axis 710. Unlike conventional downhole power-generating turbines, which require axial fluid flow and otherwise fluid flow that is parallel to the rotational axis of the turbine, the fluid 702 in the downhole power generator 226 is perpendicular to the rotational axis 710 of the transverse turbine 706. As a result, more power is generated at a given flow rate as compared to axial flow turbine assemblies.

Before impinging upon the blades 708, the fluid 702 may pass through a nozzle 712 arranged within the flow path 704 upstream from the transverse turbine 706. The nozzle 712 increases the kinetic energy of the fluid 702, which results in an increased power output from the downhole power generator 226. The transverse turbine 706 receives the fluid 702 transversely (i.e., across) the blades 708, and the fluid 702 flows through the transverse turbine 706, as indicated by the dashed arrow A. As the fluid 702 flows through the transverse turbine 706, the blades 708 are urged to rotate the transverse turbine 706 about the rotational axis 710 and thereby generate electricity in an associated power generator (not shown). The transverse turbine 706 of FIG. 7 is depicted as a cross-flow turbine but could alternatively be any other type of turbine that receives a flow of fluid perpendicular to its rotational axis.

Figure 8:
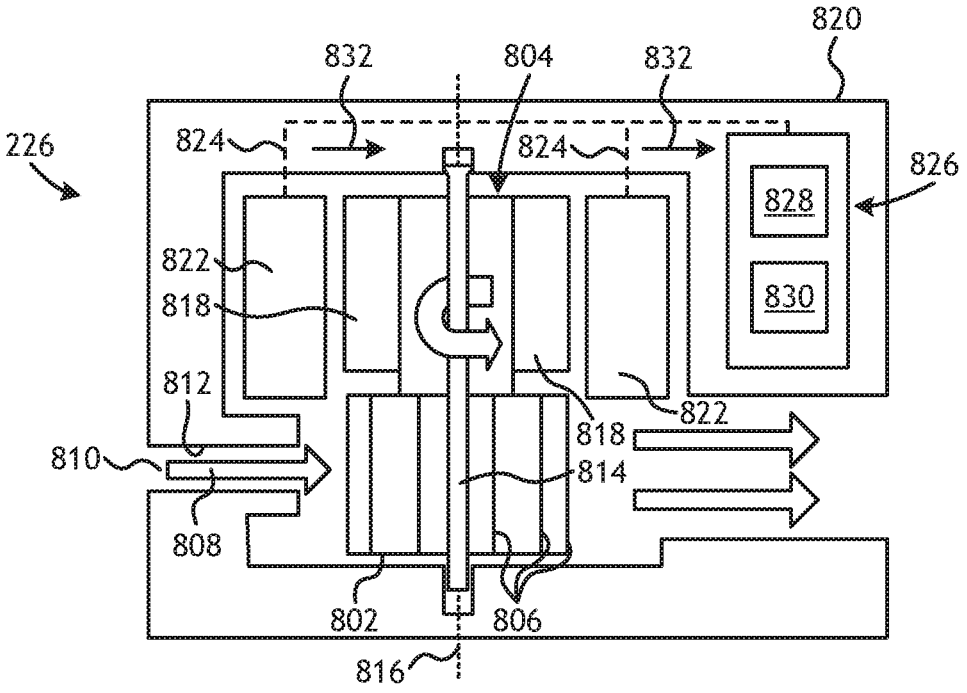
FIG. 8 is a schematic diagram of another exemplary embodiment of the downhole power generator of FIG. 2.

FIG. 8 depicts a schematic diagram of another exemplary embodiment of the downhole power generator 226 of FIG. 2, according to one or more embodiments. The downhole power generator 226 of FIG. 8 includes a transverse turbine 802 operatively coupled to a power generator 804. The transverse turbine 802 of FIG. 8 is depicted as a water wheel-type turbine and may include a plurality of blades 806 disposed thereabout and configured to receive a flow of a fluid 808 from a flow path 810 and convert the kinetic energy of the fluid 808 into rotational energy that generates electrical power. The flow path 810 may include a nozzle 812 that increases the kinetic energy of the fluid 808 before impinging upon the blades 806.

The transverse turbine 802 may be operatively coupled to a rotor 814 that rotates about a rotational axis 816. The rotor 814 may extend into the generator 804 and may include a plurality of magnets 818 disposed thereon for rotation therewith. The generator 804 may further include a stator 820 and one or more magnetic pickups or coil windings 822 positioned on the stator 820. One or more electrical leads 824 may extend from the coil windings 822 to a power conditioning unit 826, such as the power conditioning unit included in the electronics module 220 of FIG. 2. As illustrated, the power conditioning unit may include a power storage device 828 and a rectifier circuit 830 that operate to store and deliver a steady power supply for use by a load, such as the flow control device 226 (FIG. 2), the sensor module 230 (FIG. 2), or the communications module 232 (FIG. 2).

In the illustrated embodiment, the generator 804 is placed in the fluid 808 and otherwise is exposed to the fluid 808. The coil windings 822 and the leads 824 may be encapsulated or sealed with a magnetically-permeable material, such as a polymer, a metal, ceramic, an elastomer, or an epoxy, to protect the coil windings 822 and the leads 824 from potential fluid contamination, which could otherwise lead to corrosion or degradation of those components. As will be appreciated, placing the generator 804 in the fluid 808 eliminates the need for a dynamic seal around the rotor 814, which could eventually wear out, or the need for magnetic couplers, which may introduce durability issues over extended operation of the generator 804. In other embodiments, however, a dynamic seal could be employed, without departing from the scope of the disclosure.

In exemplary operation, the transverse turbine 802 receives the fluid 808 transversely (i.e., across) the blades 806, and the fluid 808 flows through the transverse turbine 802. As the fluid 808 impinges upon the blades 806, the transverse turbine 802 is urged to rotate about the rotational axis 816, thereby correspondingly rotating the magnets 818 as positioned on the rotor 814. The coil windings 822 convert the rotational motion of the rotor 814 into electric energy in the form of current 832. The current 322 then traverses the leads 824 extending to the power conditioning unit 826 for storage and rectification.

Figure 9:
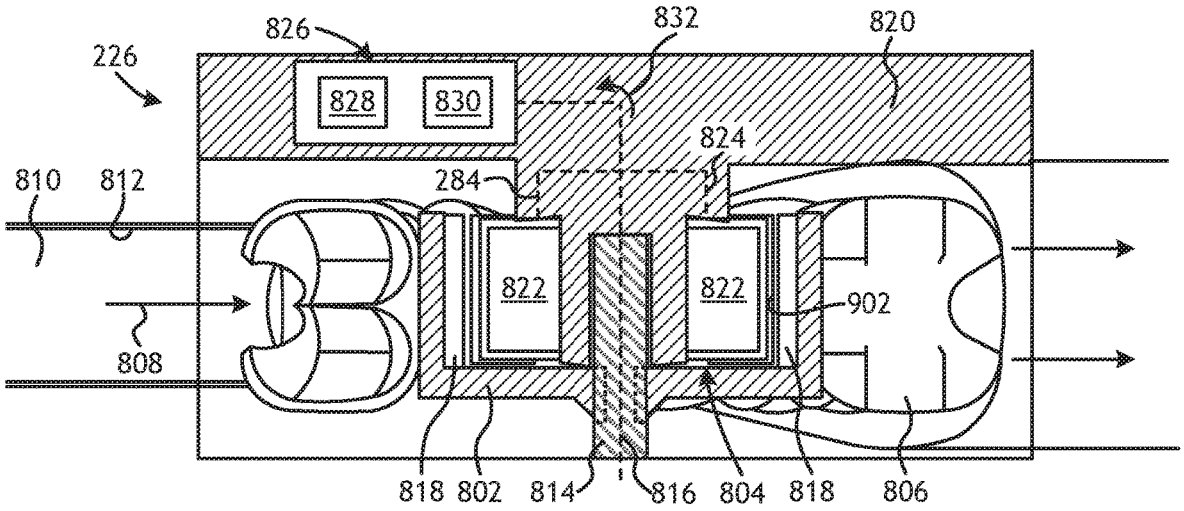
FIG. 9 is a schematic diagram of another exemplary embodiment of the downhole power generator of FIG. 2.

FIG. 9 depicts a schematic diagram of another exemplary embodiment of the downhole power generator 226 of FIG. 2, according to one or more embodiments. The downhole power generator 226 of FIG. 2 may be similar in some respects to the downhole power generator 226 of FIG. 8 and therefore will be best understood with reference thereto, where like numerals indicate like components or elements not described again. Similar to the downhole power generator 226 of FIG. 8, the downhole power generator 226 of FIG. 9 includes the transverse turbine 802, the generator 804, and the blades 806 disposed about the transverse turbine 802 and to receive the fluid 808 from the flow path 810 and convert kinetic energy of the fluid 808 into rotational energy that generates electrical power. The nozzle 812 is positioned within the flow path 810 to increase the kinetic energy of the fluid 808 before impinging upon the blades 806.

Unlike the downhole power generator 226 of FIG. 8, however, the transverse turbine 802 of the downhole power generator 226 of FIG. 9 may be characterized as a Pelton wheel or a Turgo turbine, and the generator 804 of the downhole power generator 226 of FIG. 9 may be generally positioned within the transverse turbine 802, which reduces the axial height of the transverse turbine assembly 400. More specifically, as illustrated, the transverse turbine 802 may be coupled to the rotor 814 to rotate about the rotational axis 816, and the plurality of magnets 818 may be disposed or otherwise positioned on the transverse turbine 802 for rotation therewith. The stator 820 may extend at least partially into a hub 902 defined by the transverse turbine 802 and the magnetic pickups or coil windings 822 may be positioned within the hub 902 to interact with the magnets 818. As will be appreciated, this embodiment allows the generator 804 to have a very short axial length as compared to the generator 804 of FIG. 8.

Operation of the downhole power generator 226 of FIG. 9 may be substantially similar to operation of the downhole power generator 226 of FIG. 8 and therefore will not be described again. Any type or configuration of turbine that is configured to receive fluid flow perpendicular to the rotational axis of the turbine may be suitable for use in any of the embodiments described herein. For instance, in other embodiments, a Francis or Jonval turbine may also be used, without departing from the scope of the disclosure.

Embodiments disclosed herein include:

A. A sand control screen assembly that includes a base pipe defining an interior and one or more flow ports that facilitate fluid communication between the interior and an exterior of the base pipe, a flow control device positioned within a flow path for a fluid that extends between the exterior and the interior of the base pipe, the flow control device including a housing that defines an inlet that receives the fluid from the flow path and an outlet that discharges the fluid back into the flow path, a piston chamber defined in the housing and fluidly communicating the inlet with the outlet, a pressure-balanced piston positioned within the piston chamber and movable between a first position, where fluid flow through the piston chamber between the inlet and the outlet is prevented, and a second position, where fluid flow between the inlet and the outlet is facilitated, and an actuator operatively coupled to the pressure-balanced piston to move the pressure-balanced piston between the closed and open positions. The sand control screen assembly further including an electronics module communicably coupled to the flow control device to operate the actuator and thereby regulate the fluid flow through the control device.

B. A method that includes positioning a base pipe within a wellbore adjacent a subterranean formation, the base pipe having an interior, an exterior, and one or more flow ports defined through the base pipe to facilitate fluid communication between the interior and the exterior, drawing a fluid into a flow path that extends between the exterior and the interior of the base pipe and flowing the fluid into a flow control device positioned within the flow path and including a housing that defines an inlet that receives the fluid from the flow path and an outlet that discharges the fluid back into the flow path, a piston chamber defined in the housing and fluidly communicating the inlet with the outlet, a pressure-balanced piston positioned within the piston chamber and including a piston rod and first and second piston heads coupled to the piston rod and axially spaced from each other, and an actuator operatively coupled to the pressure-balanced piston. The method further including regulating fluid flow through the flow control device with an electronics module communicably coupled to the flow control device, wherein regulating fluid flow includes operating the actuator to move the pressure-balanced piston between a first position, where fluid flow through the piston chamber between the inlet and the outlet is prevented, and a second position, where fluid flow between the inlet and the outlet is facilitated.

Each of embodiments A and B may have one or more of the following additional elements in any combination: Element 1: wherein the pressure-balanced piston includes a piston rod and first and second piston heads coupled to the piston rod and axially spaced from each other, and wherein the flow control device further comprises a first branch extending from the inlet and communicating with the piston chamber upstream from a first choke point provided in the piston chamber, and a second branch extending from the inlet and communicating with the piston chamber upstream from a second choke point provided in the piston chamber and axially offset from the first choke point, wherein the first and second piston heads axially align with the first and second choke points, respectively, when the pressure-balanced piston is in the closed position. Element 2: wherein the first and second choke points each provide a reduced diameter portion of the piston chamber. Element 3: further comprising one or more follower magnets coupled to the piston rod, and one or more drive magnets positioned within a drive magnet chamber defined in the housing and operatively coupled to an actuator rod of the actuator, wherein the one or more follower magnets are magnetically coupled to the one or more drive magnets such that axial movement of the one or more drive magnets within the drive magnet chamber correspondingly moves the pressure-balanced piston within the piston chamber. Element 4: wherein the one or more drive magnets comprise a first set of drive magnets extending longitudinally within a first drive magnet chamber, and a second set of drive magnets extending longitudinally within a second drive magnet chamber, wherein the first and second sets of drive magnets are each coupled to the actuator rod at a coupling and each is magnetically coupled to the one or more follower magnets. Element 5: wherein a wall of the housing interposes the piston chamber and the drive magnet chamber such that the drive magnet chamber is isolated from the piston chamber. Element 6: wherein the one or more follower magnets are coupled to the piston rod axially between the first and second piston heads. Element 7: wherein one or both of the first and second piston heads exhibit a cross-sectional area having a tapered surface that is angled from an upstream side to a downstream side. Element 8: further comprising a downhole power generator positioned within the flow path to generate electrical power. Element 9: wherein the downhole power generator is communicably coupled to at least one of the electronics module or the flow control device. Element 10: wherein the downhole power generator comprises a transverse flow turbine assembly. Element 11: further comprising a sensor module communicably coupled to the electronics module and including one or more sensors used to obtain measurement data corresponding to the fluid. Element 12: further comprising a communications module communicably coupled to the electronics module and a well surface location to transfer data and/or control signals to/from the electronics module and the well surface location.

Element 13: wherein flowing the fluid into the flow control device comprises flowing the fluid into a first branch extending from the inlet and communicating with the piston chamber upstream from a first choke point provided in the piston chamber, and flowing the fluid into a second branch extending from the inlet and communicating with the piston chamber upstream from a second choke point provided in the piston chamber and axially offset from the first choke point, wherein the first and second piston heads axially align with the first and second choke points, respectively, when the pressure-balanced piston is in the closed position. Element 14: wherein one or more follower magnets are coupled to the piston rod and one or more drive magnets are positioned within a drive magnet chamber defined in the housing and operatively coupled to an actuator rod of the actuator, and wherein operating the actuator comprises magnetically coupling the one or more follower magnets to the one or more drive magnets, and axially moving the one or more drive magnets within the drive magnet chamber and thereby moving the pressure-balanced piston within the piston chamber. Element 15: further comprising generating electrical power with a downhole power generator positioned within the flow path, and providing the electrical power to at least one of the electronics module and the flow control device. Element 16: further comprising monitoring a physical or chemical property of the fluid with a sensor module communicably coupled to the electronics module, providing measurement data to the electronics module from the sensor module, and operating the flow control device based on the measurement data. Element 17: wherein providing the measurement data to the electronics module further comprises transmitting the measurement data to a well surface location with a communications module communicably coupled to the electronics module and the well surface location, transmitting a command signal to the communications module from the well surface location, and conveying the command signal to the electronics module to operate the flow control device in response to the command signal. Element 18: wherein providing the measurement data to the electronics module further comprises processing the measurement data with the electronics module, autonomously regulating operation of the flow control device when the measurement data surpasses a measured predetermined threshold of operation.

By way of non-limiting example, exemplary combinations applicable to A, B, and C include: Element 1 with Element 2; Element 1 with Element 3; Element 3 with Element 4; Element 3 with Element 5; Element 3 with Element 6; Element 8 with Element 9; Element 8 with Element 10; Element 13 with Element 14; Element 16 with Element 17; and Element 16 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sand control screen assembly, comprising:

a base pipe defining an interior and one or more flow ports that facilitate fluid communication between the interior and an exterior of the base pipe;

a flow control device positioned within a flow path for a fluid that extends between the exterior and the interior of the base pipe, the flow control device including:

a housing that defines an inlet that receives the fluid from the flow path and an outlet that discharges the fluid back into the flow path;

a piston chamber defined in the housing and fluidly communicating the inlet with the outlet;

a pressure-balanced piston positioned within the piston chamber and movable between a first position, where fluid flow through the piston chamber between the inlet and the outlet is prevented, and a second position, where fluid flow between the inlet and the outlet is facilitated, wherein the pressure-balanced piston is pressure balanced in an open position, a partially open position, or a closed position; and an actuator operatively coupled to the pressure-balanced piston to move the pressure-balanced piston between the closed and open positions; and an electronics module communicably coupled to the flow control device to operate the actuator and thereby regulate the fluid flow through the control device;

a first branch extending from the inlet and communicating with the piston chamber upstream from a first choke point provided in the piston chamber, and a second branch extending from the inlet and communicating with the piston chamber upstream from a second choke point provided in the piston chamber an axially offset from the first choke point, wherein the first and second piston heads axially align with the first and second choke points, respectively, when the pressure-balanced piston is in the closed position.

2. The sand control screen assembly of claim 1, wherein the pressure-balanced piston includes a piston rod and first and second piston heads coupled to the piston rod and axially spaced from each other.

3. The sand control screen assembly of claim 2, wherein the first and second choke points each provide a reduced diameter portion of the piston chamber.

4. The sand control screen assembly of claim 2, further comprising:

one or more follower magnets coupled to the piston rod; and one or more drive magnets positioned within a drive magnet chamber defined in the housing and operatively coupled to an actuator rod of the actuator, wherein the one or more follower magnets are magnetically coupled to the one or more drive magnets such that axial movement of the one or more drive magnets within the drive magnet chamber correspondingly moves the pressure-balanced piston within the piston chamber.

5. The sand control screen assembly of claim 4, wherein the one or more drive magnets comprise:

a first set of drive magnets extending longitudinally within a first drive magnet chamber; and a second set of drive magnets extending longitudinally within a second drive magnet chamber, wherein the first and second sets of drive magnets are each coupled to the actuator rod at a coupling and each is magnetically coupled to the one or more follower magnets.

6. The sand control screen assembly of claim 4, wherein a wall of the housing interposes the piston chamber and the drive magnet chamber such that the drive magnet chamber is isolated from the piston chamber.

7. The sand control screen assembly of claim 4, wherein the one or more follower magnets are coupled to the piston rod axially between the first and second piston heads.

8. The sand control screen assembly of claim 1, wherein one or both of a first and second piston heads exhibit a cross-sectional area having a tapered surface that is angled from an upstream side to a downstream side.

9. The sand control screen assembly of claim 1, further comprising a downhole power generator positioned within the flow path to generate electrical power.

10. The sand control screen assembly of claim 9, wherein the downhole power generator is communicably coupled to at least one of the electronics module or the flow control device.

11. The sand control screen assembly of claim 9, wherein the downhole power generator comprises a transverse flow turbine assembly.

12. The sand control screen assembly of claim 1, further comprising a sensor module communicably coupled to the electronics module and including one or more sensors used to obtain measurement data corresponding to the fluid.

13. The sand control screen assembly of claim 1, further comprising a communications module communicably coupled to the electronics module and a well surface location to transfer data and/or control signals to/from the electronics module and the well surface location.

14. A method, comprising:

positioning a base pipe within a wellbore adjacent a subterranean formation, the base pipe having an interior, an exterior, and one or more flow ports defined through the base pipe to facilitate fluid communication between the interior and the exterior;

drawing a fluid into a flow path that extends between the exterior and the interior of the base pipe and flowing the fluid into a flow control device positioned within the flow path and including:

a housing that defines an inlet that receives the fluid from the flow path and an outlet that discharges the fluid back into the flow path;

a piston chamber defined in the housing and fluidly communicating the inlet with the outlet;

a pressure-balanced piston positioned within the piston chamber and including a piston rod and first and second piston heads coupled to the piston rod and axially spaced from each other wherein the pressure-balanced piston is pressure balanced in an open position, a partially open position, or a closed position; and an actuator operatively coupled to the pressure-balanced piston; and regulating fluid flow through the flow control device with an electronics module communicably coupled to the flow control device, wherein regulating fluid flow includes operating the actuator to move the pressure-balanced piston between a first position, where fluid flow through the piston chamber between the inlet and the outlet is prevented, and a second position, where fluid flow between the inlet and the outlet is facilitated, wherein flowing the fluid into the flow control device comprises:

flowing the fluid into a first branch extending from the inlet and communicating with the piston chamber upstream from a first choke point provided in the piston chamber; and flowing the fluid into a second branch extending from the inlet and communicating with the piston chamber upstream from a second choke point provided in the piston chamber and axially offset from the first choke point, wherein the first and second piston heads axially align with the first and second choke points, respectively, when the pressure-balanced piston is in the closed position.

15. The method of claim 14, wherein one or more follower magnets are coupled to the piston rod and one or more drive magnets are positioned within a drive magnet chamber defined in the housing and operatively coupled to an actuator rod of the actuator, and wherein operating the actuator comprises:

magnetically coupling the one or more follower magnets to the one or more drive magnets; and axially moving the one or more drive magnets within the drive magnet chamber and thereby moving the pressure-balanced piston within the piston chamber.

16. The method of claim 14, further comprising:

generating electrical power with a downhole power generator positioned within the flow path; and providing the electrical power to at least one of the electronics module and the flow control device.

17. The method of claim 14, further comprising:

monitoring a physical or chemical property of the fluid with a sensor module communicably coupled to the electronics module;

providing measurement data to the electronics module from the sensor module; and operating the flow control device based on the measurement data.

18. The method of claim 17, wherein providing the measurement data to the electronics module further comprises:

transmitting the measurement data to a well surface location with a communications module communicably coupled to the electronics module and the well surface location;

transmitting a command signal to the communications module from the well surface location; and conveying the command signal to the electronics module to operate the flow control device in response to the command signal.

19. The method of claim 17, wherein providing the measurement data to the electronics module further comprises:

processing the measurement data with the electronics module; and autonomously regulating operation of the flow control device when the measurement data surpasses a measured predetermined threshold of operation.

* * * * *